United States Patent [19]

Forssberg et al.

[11] 4,122,005

[45] Oct. 24, 1978

[54] MAGNETIC SEPARATOR

[75] Inventors: Knut Sven Erik Forssberg, Gammelstad; Karl Dieter Kopp, Enebyberg, both of Sweden

[73] Assignee: Mineral Processing Development & Innovation AB, Gammelstad, Sweden

[21] Appl. No.: 806,190

[22] Filed: Jun. 13, 1977

[30] Foreign Application Priority Data

Jun. 11, 1976 [SE] Sweden ..... 7606706

[51] Int. Cl.[2] ..... B03C 1/02

[52] U.S. Cl. ..... 209/232; 209/219; 210/222

[58] Field of Search ..... 209/219, 223 R, 232, 209/220, 231; 204/225; 210/222, 223

[56] References Cited

U.S. PATENT DOCUMENTS

| | | | |
|---|---|---|---|
| 882,158 | 3/1908 | Moffatt | 209/219 |
| 1,062,522 | 5/1913 | Ullrich | 209/223 R X |
| 1,114,071 | 10/1914 | Ullrich | 209/219 |
| 3,246,753 | 4/1966 | Laurila | 209/219 |
| 3,850,811 | 11/1974 | Wheelock | 209/223 R X |
| 3,920,543 | 11/1975 | Marston | 209/232 X |

FOREIGN PATENT DOCUMENTS

| | | | |
|---|---|---|---|
| 1,348,410 | 12/1963 | France | 209/219 |
| | | [illegible] Germany | 209/219 |
| 252,034 | 5/1926 | United Kingdom | 209/220 |
| 303,513 | 3/1930 | United Kingdom | 209/219 |
| 730,332 | 9/1955 | United Kingdom | 209/232 |

*Primary Examiner*—Robert Halper

*Attorney, Agent, or Firm*—Burns, Doane, Secker & Mathis

[57] ABSTRACT

A magnetic separator comprises a magnet and an iron cylinder rotatable in a gap in the magnet. The cylinder and the lower pole face of the magnet define a separator chamber. An aqueous suspension of magnetizable and non-magnetic particles is supplied to the separator chamber through channels extending through the magnet.

5 Claims, 4 Drawing Figures

MAGNETIC SEPARATOR

The invention relates to a magnetic separator, and more particularly to a magnetic separator of the type comprising an electromagnet with an iron core, an iron cylinder or rotor being arranged in an opening in a gap in the magnet, a driving means for the rotor, means for passing an aqueous suspension of finely divided material for separation to the gap and means for collecting the magnetic and non-magnetic fractions formed on separation.

A magnetic separator of this kind is used for wet, strongly magnetic separation. This means that the separator generally works with a magnetic field strength of more than about 12,000 Gauss. The material for separation is supplied to the separator in the form of an aqueous suspension, or pulp, of finely particulate material. The magnetic material is generally a paramagnetic material, usually a mineral which is to be separated from gangue. Examples of minerals which to advantage can be subjected to wet strongly magnetic separation are: hematite, $Fe_2O_3$; geothite, FeOOH; fayalite, $Fe_2SiO_4$; siderite, $FeCO_3$; and ilmenite, $FeTiO_3$.

Previously, known magnetic separators of the kind mentioned above have been burdened with certain disadvantages. As a rule, the pulp has moved in the same direction as the rotor. Separation of magnetic and non-magnetic material has not been satisfactory in these separators.

The object of the invention is to find a remedy to these disadvantages. The magnetic separator according to the invention comprises an iron cylinder rotatable around a horizontal axis, means for rotating said cylinder, a magnet having a first pole face situated substantially below said cylinder, and a second pole face situated substantially above said cylinder, said first pole face and said cylinder defining a separator chamber said separator chamber having a first opening where the surface of the cylinder enters the separator chamber, and a second opening where the surface of the cylinder leaves the separator chamber, channels for supplying a suspension of magnetizable and non-magnetic particles in a liquid to an intermediate zone of said separator chamber, said channels extending through said magnet, means adjacent said first opening for collecting the suspension depleted of magnetizable particles, and means adjacent said second opening for removing magnetizable particles from the surface of the cylinder and for collecting such particles.

The invention will now be explained while referring to the appended drawing.

Figure 1:
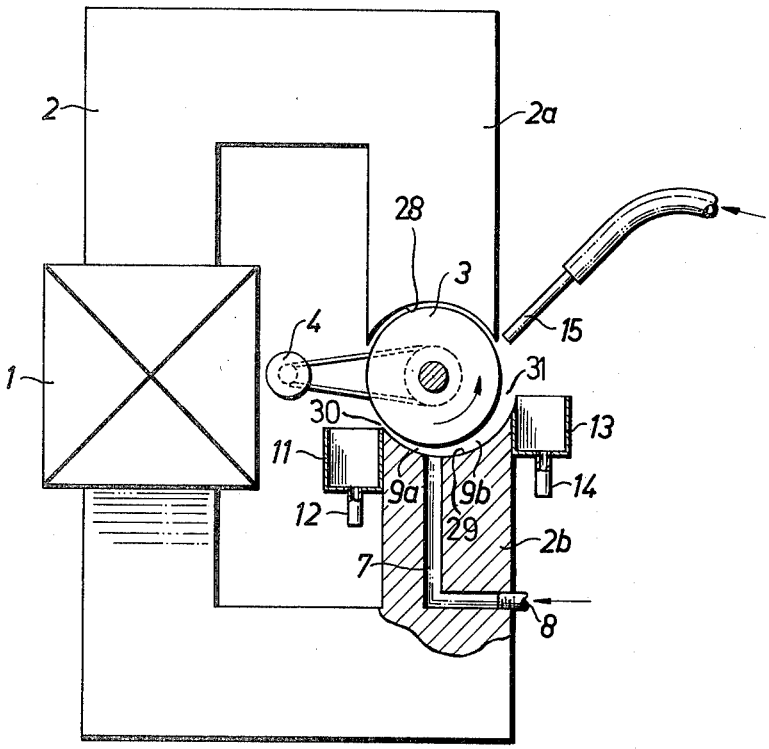
FIG. 1 shows, partly in section, a magnetic separator according to the invention.
Figure 2:
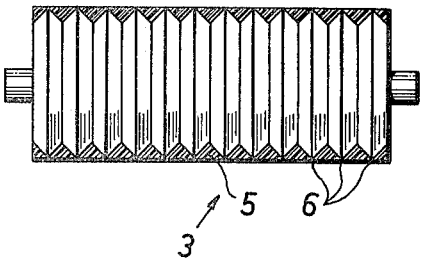
FIG. 2 shows a section through the cylinder in the separator according to FIG. 1.

The separator according to FIGS. 1 and 2 contains an electromagnet consisting of a magnet coil 1 and an iron core 2. The magnet has a gap defined by an upper pole face, 28, and a lower pole face, 29. There is a cylinder 3 mounted in said gap, and aranged to be driven in the direction of the arrow 17 by a motor 4. The diameter of the rotor is substantially the same as the width of the magnet. The material of the cylinder is iron having a low residual magnetism. The surface of the cylinder is provided with peripheral grooves 5. The intermediate ridge portions 6 generate the magnetic gradients necessary for the magnetic separation. The grooves 5 are filled with plastic so that the cylinder is given a smooth surface for facilitating practical operation.

Channels 7 are arranged in the portion of the magnet lying under the cylinder 3. Upwardly, the channels open into the gap 9*a*, 9*b* between the cylinder 3 and the lower pole face 29. Downwardly, the channels are connected to a pipe 8 through which suspension is supplied to the separator. Said gap 9*a*, 9*b* acts as a separator chamber, and has a first opening 30 where the surfaces of the cylinder 3 enters the gap portion 9*a*, and a second opening 31 where the surface of the cylinder 3 leaves the gap portion 9*b*. The separator chamber 9*a*, 9*b* has a continuously increasing width from the first opening 30 to the second opening 31. The magnet portion 2*b* below the cylinder 3 has been placed non-symmetrically in relation to the cylinder 3. The pole surface 29 has been given such a shape that the second opening 31 is situated at a level higher than the first opening 30. A collecting trough 11 with an outlet 12 is arranged adjacent the first opening 30. A collecting trough 13 having an outlet 17 is arranged adjacent the second opening 31. Above the trough 13 there are arranged nozzles 15 through which water can be sprayed onto the surface of the cylinder 3.

The separator according to FIGS. 1 and 2 works in the following manner:

An aqueous suspension containing magnetizable particles and non-magnetic particles is supplied to the separator chamber 9*a*, 9*b* through the pipe 8 and the channel 7. The suspension flows through the chamber portion 9*a* in counter-current flow to the movement of the surface of the cylinder 3. The magnetizable particles in the suspension are attracted by the cylinder 3, i.e. by the upstanding portions 6 where the magnetic field has a high gradient. The non-magnetid particles in the suspension accompany the water through the opening 30, to the collecting trough 11 and leave the apparatus through the outlet 12. The magnetizable particles accompany the cylinder 3 into the separator chamber portion 9*b*. In the zone adjacent the openings of the channels 7 there prevails heavy turbulence and magnetic particles can be loosened from the cylinder here. These magnetizable particles are again attracted by the cylinder 3 in the wider chamber portion 9*b*. The fact that the magnetizable particles get loose from the cylinder 3, and are again attracted by the cylinder, is believed to have a favourable influence on the separation, because agglomerates of magnetizable and non-magnetic particles will be broken up. The magnetizable particles adhere to the cylinder 3 while its surface is being lifted up from the water, the water level being a bit lower than the opening 31. When the surface of the cylinder has left the opening 31, the magnetizable particles are no longer exposed to the magnetic field. Therefore, the majority of the magnetizable particles loosens spontaneously from the cylinder. Particles still adhering to the cylinder are washed away by the water jets from the nozzles 15. All magnetic particles are thus collected in the trough 13, and leave the apparatus through the outlet 14.

In the separator according to FIG. 1, the channels 7 open out at approximately half the length of the separator chamber 9*a*, 9*b*, i.e. the chamber portions 9*a* is approximately as long as the chamber portion 9*b*. We prefer to let the channels 7 open out into the separator chamber at 50–75% of its length. beginning at the first opening 30. This means that the separator chamber portion **9*b*** has a length of about 25–50% of the total separator chamber length.

Figure 3:
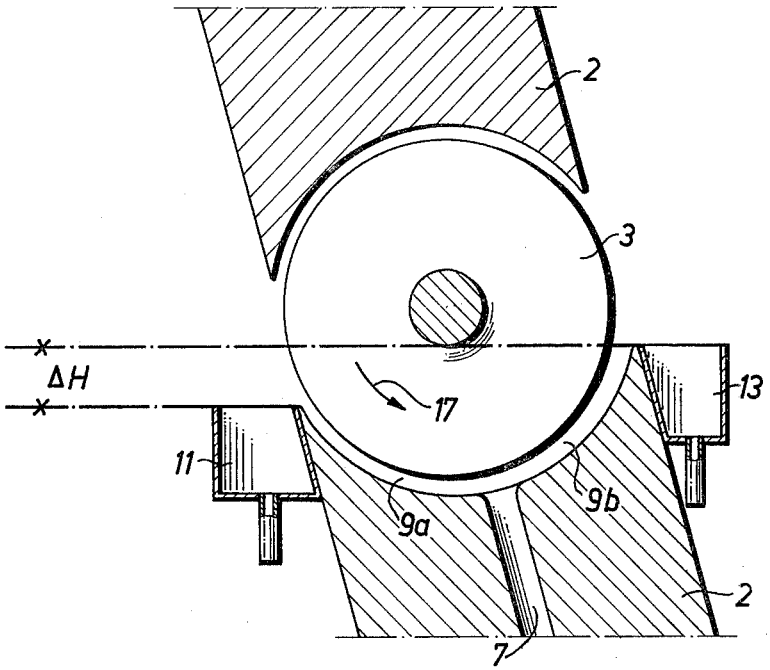
FIG. 3 shows a section through a portion of another embodiment of the magnetic separator according to the invention.

As has been explained above, the non-symmetrical position of the magnet portion **2*b*, and the shape of the pole face 29, have resulted in the first opening 30 being positioned lower than the second opening. FIG. 3 illustrates another way of achieving the same result. According to FIG. 3 the magnet has been placed so that the magnet portion 2** forms an angle to the vertical. Said angle is preferably below 40°. The difference in level between the two openings of the separator chamber is $\Delta H$.

Figure 4:
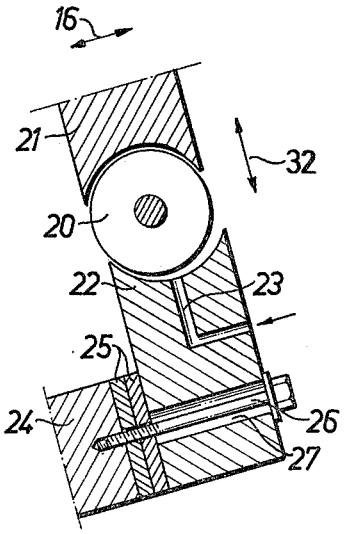
FIG. 4 illustrates means for changing the shape of the separator chamber.

FIG. 4 illustrates how the shape of the separator chamber can be varied. The lower pole 22 of the magnet is fastened to a substantially horizontal portion 24 of the magnet by means of screws 26. The openings 27 for the screws have an elongated cross-sectional shape. This means that the position of the pole 22 can be varied as indicated by the arrow 32. A desired number of plates or washers 25 can be positioned between the magnet portions 22 and 24. By varying the number of washers 25 the position of the pole 22 can be varied as indicated by the arrow 16. Consequently, the separator chamber portion **9*a* can be given a diminishing width in the direction of travel of the suspension. This is advantageous to the capacity and effectiveness of the magnetic separator, because of two factors. Firstly, the thickness of the layer of magnetic material attracted to the surface of the cylinder will increase. Secondly, the viscosity of the suspension will decrease when it flows through the chamber portion 9*a* in the opposite direction to the arrow 17, because the solids content of the pulp decreases as it is depleted of magnetic material. By forming the chamber portion 9*a* with diminishing width in the direction of the suspension travel, there is the possibility of maintaining the average separator chamber width at a minimum. The exact cross-sectional shape of the chamber portion 9*a*** must be adjusted from case to case, inter alia depending on the character of the magnetic material and gangue.

The illustrated separator can be varied in different ways within the scope of the invention. Accordingly, a cylinder with a smooth surface can be obtained by building it up from alternately placed discs of iron and copper. The scraper can be made in another way, e.g. as a mechanical scraper.

What is claimed is:

1. A magnetic separator comprising:

an iron cylinder rotatable around a horizontal axis, means for rotating said cylinder, a magnet having a first pole face situated substantially below said cylinder, and a second pole face situated substantially above said cylinder, said first pole face and said cylinder defining a separator chamber, said separator chamber having a first opening where the surface of the cylinder enters the separator chamber, and a second opening where the surface of the cylinder leaves the separator chamber, channels for supplying a suspension of magnetizable and non-magnetic particles in a liquid to an intermediate zone of said separator chamber, said channels extending through said magnet, and said first pole face said first opening being situated lower than the second opening to facilitate a flow of said suspension countercurrent to the movement of the surface of said cylinder in at least a portion of said chamber, means adjacent said first opening for collecting the suspension depleted of magnetizable particles, and means adjacent said second opening for removing magnetizable particles from the surface of the cylinder and for collecting such particles.

2. A magnetic separator as claimed in claim 1, wherein the channels are arranged to open out into the separator chamber at a point lying at a distance of 50–75% of the chamber length, calculated from the first opening to the second opening.

3. A magnetic separator as claimed in claim 1, wherein the magnet is arranged inclined to the vertical plane, so that the first opening is lower than the second opening.

4. A magnetic separator as claimed in claim 1 further including means for securing one of said pole faces to a support structure, and means for varying the orientation of said mounted pole face in the vertical and in the horizontal direction with respect to the axis of said cylinder to vary the cross-sectional shape of the separator chamber.

5. A magnetic separator as in claim 1 wherein the surface of each pole face substantially conforms to the surface of said cylinder and wherein one of said pole faces is non-symmetrically positioned with respect to the axis of said cylinder to provide a separator chamber with a varying width.

* * * * *